United States Patent [19]

Bourgeois et al.

[11] 4,203,766

[45] May 20, 1980

[54] PHOTOGRAPHIC PRODUCTS COMPRISING DYE DEVELOPERS AND N-OXIDES

[75] Inventors: Gerard J. Bourgeois, Kingston; Russell A. Gaudiana, Merrimack, both of N.H.; Ronald A. Sahatjian, Lexington, Mass.

[73] Assignee: Polaroid Corporation, Cambridge, Mass.

[21] Appl. No.: 34,868

[22] Filed: Apr. 30, 1979

Related U.S. Application Data

[63] Continuation-in-part of Ser. No. 811,083, Jun. 29, 1977, abandoned.

[51] Int. Cl.[2] ..... G03C 7/00; G03C 5/54; G03C 1/40; G03C 1/10

[52] U.S. Cl. ..... 430/243; 430/218; 430/224; 430/541; 430/560

[58] Field of Search ..... 96/29 D, 77, 95, 99, 96/3

[56] References Cited

U.S. PATENT DOCUMENTS

| | | | |
|---|---|---|---|
| 2,892,710 | 6/1959 | Cohler et al. | 96/95 |
| 2,983,606 | 5/1961 | Rogers | 96/3 |
| 3,173,929 | 3/1965 | Kasman | 260/371 |
| 3,340,063 | 9/1967 | Kalenda | 96/95 |
| 3,998,640 | 12/1976 | Ciurca et al. | 96/77 |
| 4,006,150 | 2/1977 | Greenwald | 96/29 D |

*Primary Examiner*—Richard L. Schilling
*Attorney, Agent, or Firm*—Louis G. Xiarhos

[57] ABSTRACT

This invention is concerned with the use of certain pyridine N-oxides in diffusion transfer products and processes employing dye developers.

45 Claims, 4 Drawing Figures

PHOTOGRAPHIC PRODUCTS COMPRISING DYE DEVELOPERS AND N-OXIDES

CROSS-REFERENCE TO RELATED APPLICATION

This application is a continuation-in-part of our earlier filed and copending application Serial No. 811,083, filed June 29, 1977, now abandoned.

BACKGROUND OF THE INVENTION

1. Field of the Invention

This invention relates to diffusion transfer photographic products and processes employing dye developers. More precisely this invention relates to the use of certain pyridine N-oxides to provide improved processing performance characteristics for such products and processes.

2. Description of the Prior Art

Diffusion transfer photographic processes and products employing dye developers are known to the art and details relating to them can be found in U.S. Pat. Nos. 2,983,606; 3,345,163; 3,415,644; 3,415,645; 3,415,646; 3,473,925; 3,482,972; 3,551,406; 3,573,042; 3,573,043; 3,573,044; 3,576,625; 3,576,626; 3,578,540; 3,579,333; 3,594,164; 3,594,165; 3,597,200; 3,647,437; 3,672,486; 3,672,890; 3,705,184; 3,752,836 and 3,857,855.

Essentially, diffusion transfer photographic products and processes involve film units having a photosensitive system of element including at least one photosensitive layer usually selectively sensitized and integrated with dye developer as a dye image providing material. After photoexposure, the photosensitive layer is developed to establish an imagewise distribution of dye image providing material all or a portion of which is transferred to an image receiving element having an image receiving layer capable of mordanting or otherwise fixing the diffusible dye. The image receiving layer retains the dye image for viewing and in some diffusion transfer products, the dye image is viewed in the layer after separation from the photosensitive system while in other products, such separation is not required.

Multicolor diffusion transfer images may be obtained using dye developers by several known techniques. A particularly useful technique employs an integral multilayer photosensitive element, such as is disclosed in the referenced U.S. Patents, wherein at least two selectively sensitized photosensitive layers, superposed on a common support, are photoexposed and then processed, simultaneously without separation, with a single (common) image-receiving layer. A typical arrangement of this type for obtaining multicolor images utilizing subtractive color principles comprises a support carrying a red-sensitive silver halide emulsion layer, a green-sensitive silver halide emulsion layer and a blue-sensitive silver halide emulsion layer, each emulsion layer being associated, respectively, with a cyan dye developer; a magenta dye developer and a yellow dye developer.

The dye developer may be positioned in the silver halide emulsion layer, for example, in the form of particles, or it may be disposed in a layer behind the appropriate silver halide emulsion layer with respect to the exposing light. Each set of silver halide emulsion and associated dye developer layers may be separated from other sets by suitable interlayers, for example, by a layer of gelatin, polyvinyl alcohol, or other polymeric materials known in the art.

After photoexposure, the photosensitive element is processed by application of a processing composition in manners well known in the art. The exposed photosensitive element may be superposed prior to, during, or after application of the processing composition on a sheet-like element which may include an image receiving layer. Generally, means containing the processing composition and for discharging it within the film unit are employed for applying the processing composition to the photosensitive element in a substantially uniform layer as the photosensitive element is withdrawn from the dark chamber.

The applied liquid processing composition permeates the layers of the photosensitive element to initiate and effect development of the latent images contained there. The dye developers are immobilized or precipitated imagewise in developed areas as a consequence of and in proportion to the silver halide development. At least part of this immobilization is due to a change in the solubility characteristics of the dye developers upon oxidation and especially to a change in the solubility of the oxidized dye developer in alkaline solution. Accordingly, in undeveloped and partially developed areas of the silver halide emulsion layers, the respective unoxidized (unreacted) dye developers are diffusible. Development thus provides an imagewise distribution of unoxidized dye developer, diffusible in the alkaline processing composition, as a function of the point-to-point degree of exposure of a silver halide emulsion layer. At least part of each of these imagewise distributions of unoxidized dye developer is transferred, by imbibition, to a superposed image-receiving layer, with the transfer substantially excluding oxidized dye developer.

The image receiving layer receives a depthwise diffusion, from each developed silver halide emulsion, of unoxidized dye developer without appreciably disturbing the imagewise distribution thereof to provide a reversed or positive color image of each developed silver image. The image receiving layer may contain a mordant and/or other agent to immobilize the dye developer transferred thereto. If the color of a transferred dye developer is affected by changes in the pH of the image receiving layer, this pH may be adjusted in accordance with well known techniques to provide a pH affording the desired color.

As mentioned, the present invention is concerned with dye developer diffusion transfer processes and products in which an N-oxide is present during development. U.S. Pat. No. 3,998,640, issued Dec. 21, 1976 to S. J. Cuirca, Jr. also relates to diffusion transfer film units employing heterocyclic N-oxides as oxidants. According to the patent, the oxidants are particularly useful when employed in film units having oxichromic compounds as dye image providing materials. Oxidation of the dye image providing materials is achieved by using heterocyclic N-oxides having a polarographic reduction potential at least more positive than the polarographic oxidation potential of the dye image providing materials to be oxidized. Particularly useful N-oxides are those having a polarographic reduction potential more positive than −0.5 v. when in an aqueous solution comprising 4% potassium hydroxide.

Representative useful N-oxides disclosed in U.S. Pat. No. 3,998,640 are benzofuroxans and 4,4-axopyridine-1,1'-dioxides of the following formulae:

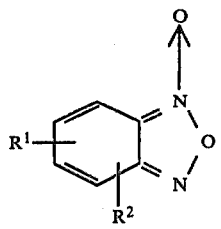

or

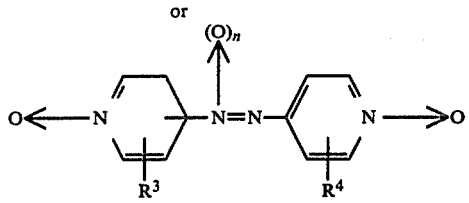

where:

$R^1$ and $R^2$ each represent a hydrogen atom, an alkyl group having 1 to 25 carbon atoms, an alkoxy group having from 1 to 25 carbon atoms, a halogen atom, a nitro group, an oxo-linked benzofuran or an organic ballasting group of such size and configuration (for example, simple organic groups or polymeric groups) as to render the compound non-diffusible, especially during treatment with an alkaline processing composition;

n is an integer having a value of 0 to 1; and $R^3$ and $R^4$ each represent a hydrogen atom, an alkyl group having 1 to 25 carbon atoms, an alkoxy group having 1 to 25 carbon atoms or an organic ballasting group as described above for $R^1$ and $R^2$. Suitable ballasting groups typically contain an alkyl group (branched or unbranched), an aryl group, an aralkyl or an alkaryl group and typically contain 8 to 25 carbon atoms.

According to the present invention, novel diffusion transfer film units employing N-oxides are presented to the art. Unlike the N-oxides of U.S. Pat. No. 3,998,640, the N-oxides employed in the present invention have polarographic reduction potentials less positive then the polarographic oxidation potential of the dye developers of the film units. As will be described in more detail in the description which follows, the use of these N-oxides provides such advantages as better control over dye transfer and particularly better control over magenta dye transfer.

SUMMARY OF THE INVENTION

The present invention provides novel diffusion transfer film units having a photosensitive system including at least one photosensitive layer associated with a dye developer and having within the film units as N-oxide as described hereinafter. Broadly, N-oxides suitable in the practice of the present invention are those which are substantially soluble in aqueous alkaline processing compositions and have a polarographic reduction potential less positive than the polarographic oxidation potential of the dye developer(s) of the film unit. Preferably, the N-oxides are integrated with the photosensitive systems of film units by coating them in suitable matrix material(s) as a layer of the film unit which can be permeated by a processing composition—applied after photoexposure of the unit—to carry at least some of the N-oxide to the photoexposed photosensitive system. Alternatively, the N-oxides can be included in diffusion transfer film units of the invention by incorporation of the N-oxides in a processing composition customarily distributed within the film units after photoexposure. Details and advantages of the invention will be better appreciated by reference to the accompanying figures taken with the following description of the preferred embodiments of the invention.

DESCRIPTION OF THE PREFERRED EMBODIMENTS

The preferred film units of the present invention are integral negative-positive film units are there are two types of such film units. Details relating to the first type are found in such patents as U.S. Pat. Nos. 3,415,644 and 3,647,437 while details of the second type are found, e.g., in U.S. Pat. No. 3,594,165.

Figure 1:
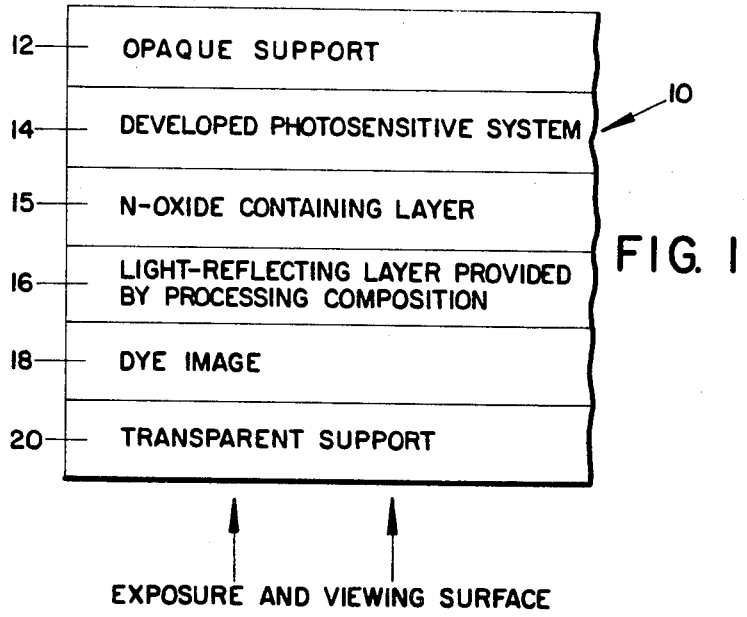
FIGS. 1–3 are simplified or schematic views of arrangements of essential elements of preferred film units of the present invention, shown after exposure and processing.

Referring now to FIG. 1 which shows a film unit of the type of referenced U.S. Pat. Nos. 3,415,644 and 3,647,437 following exposure and processing. The film unit 10 includes a light-reflecting layer 16 provided by a light-reflecting pigment in a processing composition initially present in a rupturable container (not shown) and distributed after photoexposure of photosensitive layer(s) 14 through transparent support 20, image-receiving layer 18 and N-oxide containing layer 15. Processing compositions used in such film units are aqueous alkaline photographic processing composition comprising an opacifying system which include a titanium dioxide pigment as the light reflecting agent, preferably in combination with an optical filter agent described in detail in U.S. Pat. No. 3,647,437. When the processing composition is distributed over the N-oxide-containing layer 15, a light-reflecting layer 16 comprising the titanium dioxide is provided between image-receiving layer 18 and N-oxide containing layer 15. This layer 16—at least during processing—presents sufficient opacity to protect the photosensitive system of layer 14 from further photoexposure through transparent support 20. As—and after—reflective-layer 16 is installed, the processing composition permeates N-oxide-containing layer 15 and initiates development of photoexposed photosensitive layer(s) 14 in manners well known in the art to establish an imagewise distribution of diffusible dye developer image-providing material. The diffusible dye developer(s) is transferred through permeable layer 15 and through permeable, light-reflective, titanium dioxide-containing layer 16 to be mordanted, precipitated or otherwise retained in known manner in image-receiving layer 18 where the transfer image is viewed through transparent support 20 against light-reflective layer 16.

While there is shown in FIG. 1, the incorporation of an N-oxide into a film unit in the form of an N-oxide-containing layer 15, all or a portion of the N-oxide component desireably included in the film unit can be included in the processing composition utilized for the initiation and development of photosensitive layer(s) 14 as hereinbefore described. Thus, in lieu of N-oxide-containing layer 15, a processing composition initially present in a rupturable container (not shown), and containing an N-oxide and additional components as described, can be distributed between photoexposed photosensitive system 14 and image-receiving layer 18 with provision of reflective layer 16 for the viewing of the dye image in layer 18.

Figure 2:
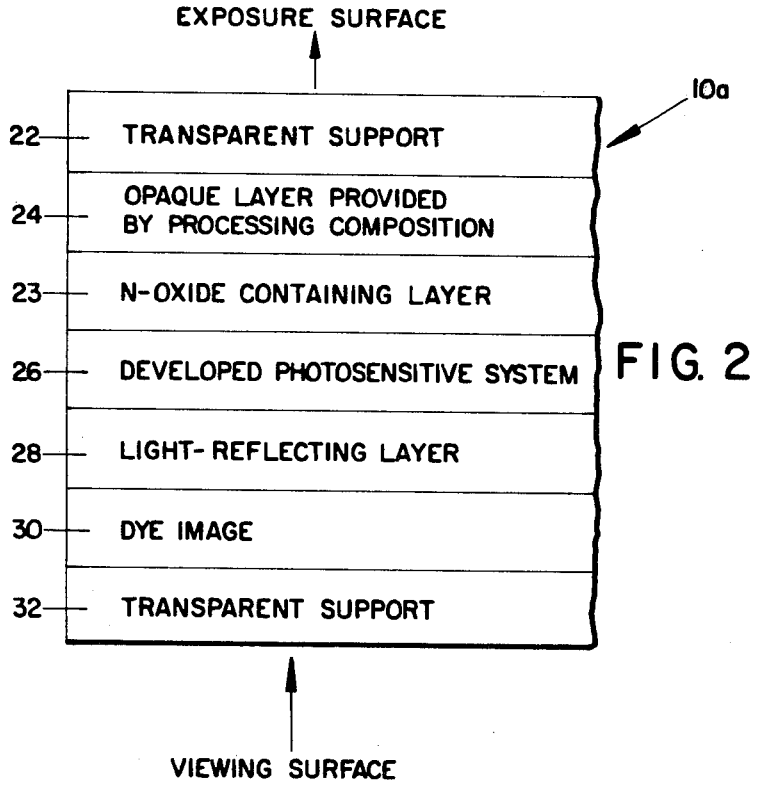

FIG. 2 shows an arrangement of essential elements of a film unit of the type described in referenced U.S. Pat. No. 3,594,165 following exposure and processing. The film unit 10*a* includes a processing composition initially retained in a rupturable container (not shown) and distributed between support 22 and N-oxide-containing layer 25 after photoexposure of photosensitive element(s) 26 through transparent support 22 and layer 25. Processing compositions used in such film units are aqueous alkaline photographic processing compositions which include an opacifying system comprising an opaque pigment which need not be—and usually is not—light reflective. After distribution of the processing composition between transparent support 22 and N-oxide-containing layer 25, an opaque layer 24 is installed which protects photoexposed photosensitive layer 26 from further photoexposure through support 22. Like the film units of FIG. 1, as and after opaque layer 24 is installed, the processing composition permeates N-oxide containing layer 25 and initiates development of photoexposed photosensitive layer 26 to establish imagewise distribution of diffusible dye developers in manners well known to the art. This imagewise distribution is transferred through permeable reflective layer 28 to dye image element 30 where the dye image is viewed through transparent support 32. An opaque layer (not shown) preferably is present between layers 26 and 28. Like the film units of FIG. 1, N-oxide-containing layer 25 need not be employed and N-oxide component can be suitably included in film unit 10*a* by incorporation into the processing composition utilized for the provision of opaque layer 24.

Figure 3:
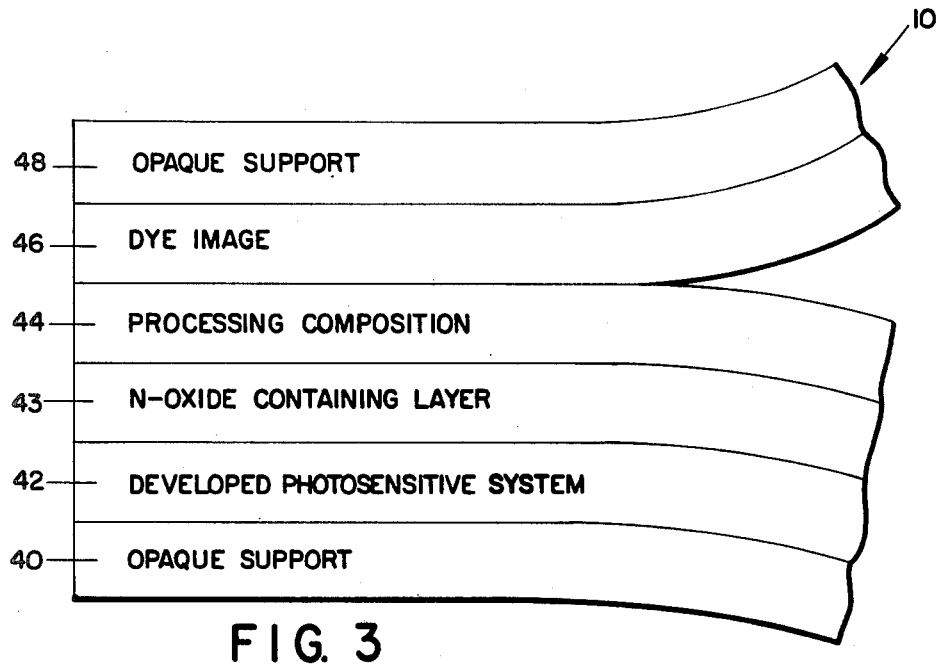

Another diffusion transfer film unit of the present invention is shown in FIG. 3 as 10*b*. The film unit shown there comprises a photosensitive element having an opaque support 40 carrying a photosensitive system containing layer(s) 42 and an N-oxide containing layer 43. In film units of this type the photosensitive element is photoexposed and a processing composition 44 is then applied over the N-oxide-containing layer 43 as an image receiving element comprising due image layer 46 and opaque support 48 is superposed on the photoexposed photosensitive element. Like the film units of FIGS. 1 and 2, the processing composition permeates N-oxide-containing layer 43 to layer 42 to there establish an imagewise distribution of diffusible dye developers which are transferred through layer 43 to dye image 46. If desired, N-oxide-containing layer 43 can be eliminated from film unit 10*b* and the N-oxide component can be suitably included in film unit 10*b* incorporation into processing composition 44 distributed from a suitable rupturable container (not shown). Unlike the film units of FIGS. 1 and 2, the transferred dye image, in the case of film unit 10*b*, is viewed in layer 46 after separation of the image-receiving element from the photosensitive element.

While film unit 10*b* is shown in FIG. 3 as including an opaque support 48, it will be appreciated that the utilization of a transparent support material in lieu of opaque support 48 will permit the provision of a transparency especially suited to projection viewing. Such a transparency will generally comprise image-containing layer 46 or a suitable transparent support of conventional film base such as polyethylene glycol terephthalate and can be conveniently mounted in known manner for projection viewing. Where a transparency is desirably prepared, development can be conducted in the dark or a removable opaque material can be superposed on the transparent support to permit in-light development and, thereafter, be removed after a suitable imbibition period and image formation.

As shown in FIGS. 1–3, a preferred manner of integrating the N-oxides with film units of this invention is by dissolving or dispersing the N-oxide in a suitable matrix material—preferably gelatin—and coating the dispersion as a top layer of the photosensitive system. In this manner, the processing composition—distributed after photoexposure—permeates the N-oxide-containing layer, carrying at least one of the N-oxide to the photoexposed photosensitive system. In accordance with our invention, it is believed that during development of the photoexposed system, the N-oxides provide a beneficial solvating action for unoxidized dye developer—particularly magenta dye developer—thereby improving transfer of unoxidized dye developer without rendering oxidized dye developer more diffusible than the dye developer would be under ordinary development conditions. These beliefs are consistent with our observations that the presence of the N-oxides during development provide more efficient dye transfer, especially more efficient magenta dye transfer.

An alternative to the integration into a film unit of N-oxide component in the form of an N-oxide-containing layer comprises the utilization as mentioned hereinbefore in a processing composition employed for initiation and development of a diffusion transfer film unit. The processing compositions employed in diffusion transfer processes of the type contemplated herein usually are aqueous alkaline compositions having a pH in excess of about 12, and frequently in the order of 14 or greater. The liquid processing compositions utilized in the diffusion transfer processes herein comprise at least an aqueous solution of an alkaline material, for example, sodium hydroxide, potassium hydroxide or the like. A suitable N-oxide component as described herein can be included in the processing composition so as to permit permeation of the N-oxide-containing processing composition into the photoexposed emulsion layer(s). The composition can additionally include known silver halide developing agents as auxiliary developers or such materials can suitably be included in the photosensitive element in known manner.

The processing composition will preferably include a viscosity-increasing compound constituting a film-forming material of the type which, when the composition is spread and dried, forms a relatively firm and relatively stable film. The preferred film-forming materials disclosed comprise high molecular weight polymers such as polymeric, water-soluble ethers which are inert to an alkaline solution such as, for example, a hydroxyethyl cellulose or sodium carboxymethyl cellulose. Additionally, film-forming materials or thickening agents whose ability to increase viscosity is substantially unaffected if left in solution for a long period of time can also be used. Examples of suitable processing compositions can be found in the aforesaid U.S. Pat. Nos. 2,983,606 and 3,345,163.

As has been set forth herein, the aqueous alkaline processing composition will preferably be included in a rupturable or frangible container. In general, such containers comprise a rectangular sheet of fluid-and air-impervious material folded longitudinally upon itself to form two walls which are sealed to one another their longitudinal and end margins to form a cavity in which the processing composition is contained. Examples of suitable rupturable containers and their methods of manufacture can be found, for example, in U.S. Pat. Nos. 2,543,181; 2,634,886; 3,653,732; 3,056,491; 3,152,515.

As mentioned, the N-oxides used in the film units of this invention are those having a polarographic reduction potential less positive then the polarographic oxidation potential of the dye developers used in the film unit. More precisely, however, the preferred N-oxides are the pyridine N-oxides conforming the following formula:

FORMULA 1

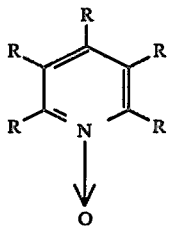

where each R can be hydrogen or methyl or one of said R groups can be:

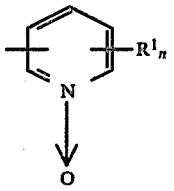

wherein $R^1$ is methyl and n is zero or an integer of from 1 to 4.

Representative of N-oxide compounds suitable herein are those having the formula:

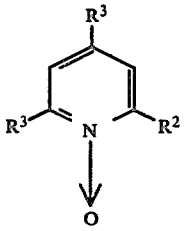

where $R^2$ and $R^3$ can be hydrogen or methyl or $R^2$ can be:

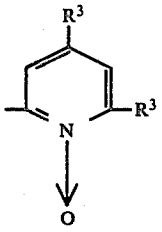

Accordingly, specific pyridine N-oxides particularly suitable in the practice of the present invention include the following:

FORMULA 2

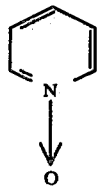

FORMULA 3

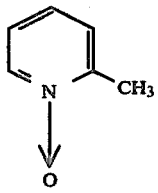

FORMULA 4

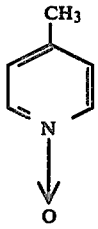

FORMULA 5

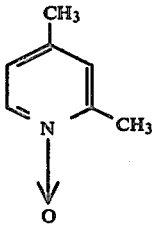

FORMULA 6

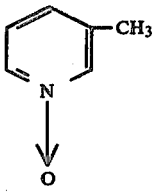

FORMULA 7

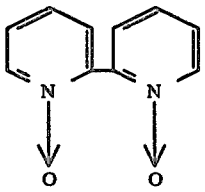

and

FORMULA 8

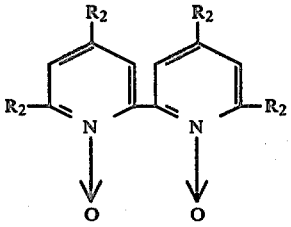

Two or more of these N-oxides may be used in the same film unit.

All of the above N-oxides are substantially soluble in aqueous alkaline processing compositions and have polarographic reduction potentials less positive than the heterocyclic N-oxide oxidants described in referenced U.S. Pat. No. 3,998,640.

It should be appreciated by those skilled in the art that the N-oxide portion of the above compounds may also be represented by the formula:

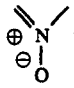

N-oxides of the above formula as well as their preparations are known to the art. For example, they can be synthesized by treating a pyridine of the formula:

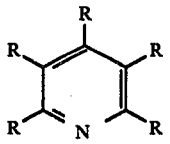

where each R is as defined before with an oxidizing agent such as peracetic acid, perbenzoic acid or m-chloroperbenzoic acid to yield the corresponding N-oxides.

The preferred embodiments of the invention as well as the advantages of the invention will be described in more detail in the following Examples. In all Examples herein, amounts and proportions are by weight.

In each of the following Examples, the multicolor photosensitive elements of the film units contained the following cyan, magenta and yellow dye developers.

cyan:

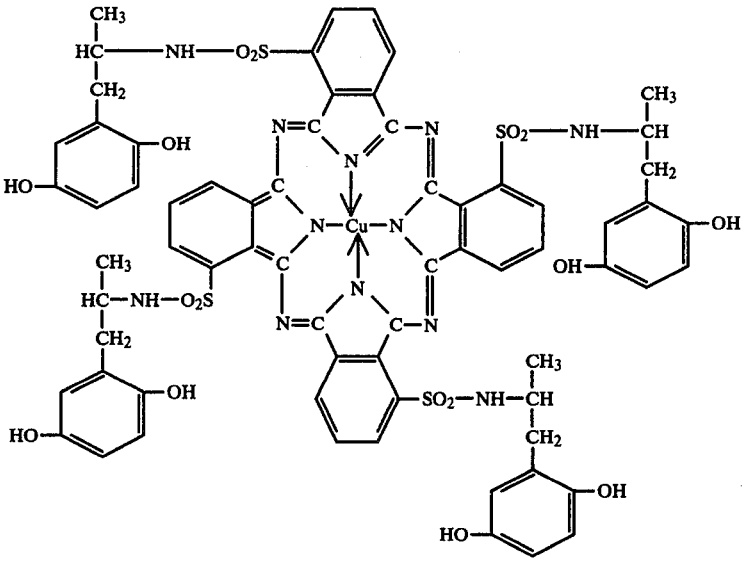

magenta:

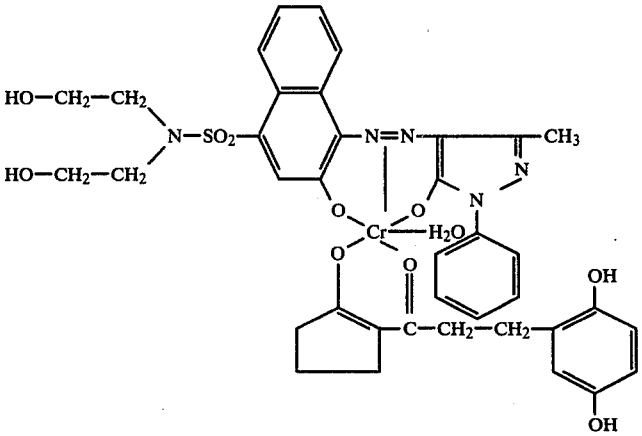

-continued yellow:

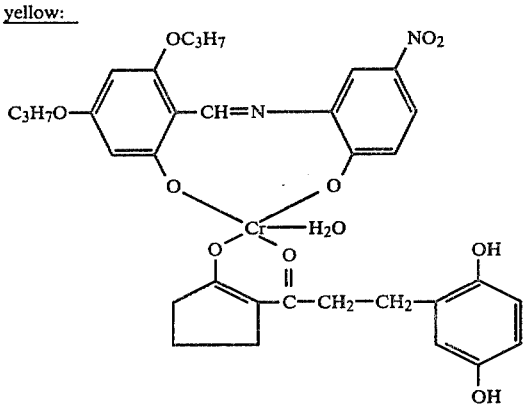

Also, except for variations explained in each following Examples 1 to 3, the film units of each of Examples 1 to 3 were prepared by coating a gelatin-subcoated, 4 mil, opaque polyethylene terephthalate film base with the following layers:

1. a layer of cyan dye developer dispersed in gelatin and coated at a coverage of about 48 mgs./ft.$^2$ of dye and about 98 mgs./ft.$^2$ of gelatin;

2. a red-sensitive gelatino silver iodobromide emulsion coated at a coverage of about 100 mgs./ft.$^2$ of silver and about 125 mgs./ft.$^2$ of gelatin;

3. a layer of 60-30-4-6 copolymer of butylacrylate, diacetone, acrylamide, styrene and methacrylic acid and polyacrylamide coated at a coverage of about 250 mgs./ft.$^2$ of the copolymer and about 8 mgs./ft.$^2$ of polyacrylamide;

4. a layer of magenta dye developer dispersed in gelatin and coated at a coverage of about 59 mgs./ft.$^2$ of dye and about 52 mgs./ft.$^2$ of gelatin;

5. a green-sensitive gelatino silver iodobromide emulsion coated at a coverage of about 64 mgs./ft.$^2$ of silver and about 54 mgs./ft.$^2$ of gelatin;

6 a layer containing the copolymer referred to above in layer 3 and polyacrylamide coated at a coverage of about 107 mgs./ft.$^2$ of copolymer and about 2 mgs./ft.$^2$ of polyacrylamide;

7. a layer of yellow dye developer dispersed in gelatin and coated at a coverage of about 80 mgs./ft.$^2$ of dye and about 56 mgs./ft.$^2$ of gelatin;

8. a blue-sensitive gelatino silver iodobromide emulsion layer including the auxiliary developer 4'-methylphenyl hydroquinone coated at a coverage of about 130 mgs./ft.$^2$ of silver, about 60 mgs./ft$^2$ of gelatin and about 39 mgs./ft.$^2$ of auxiliary developer; and 9. a layer of gelatin coated at a coverage of about 40 mgs./ft.$^2$ of gelatin.

A transparent 4 mil polyethylene terephthalate film base was coated, in succession, with the following layers to form an image-receiving component:

1. as a polymeric acid layer, a mixture of about 8:1 of the partial butyl ester of polyethylene/maleic anhydride copolymer and poly (vinyl butyral) at a coverage of about 2,500 mgs./ft.$^2$;

2. a timing layer containing about a 75:1 ratio of a 60-30-4-6 copolymer of butylacrylate, diacetone acrylamide, styrene and methacrylic acid and polyvinylalcohol at a coverage of about 500 mgs./ft.$^2$; and 3. a polymeric image-receiving layer containing a 2:1 mixture, by weight, of polyvinyl alcohol and poly-4-vinylpyridine, at a coverage of about 300 mgs./ft.$^2$ After photoexposure as described below, the two components were taped together at one end with a rupturable container retaining an aqueous alkaline processing composition so mounted that pressure applied to the container could rupture the container's marginal seal and distribute the processing composition between the image receiving layer and the gelatin overcoat layer of the photosensitive component. (In the commercial production of such film units white tapes are used to tape the components together and these tapes provide a substantially opaque border about the film unit defining an image-viewing area through which a dye image can be viewed. Exposure is also made through this image receiving area.)

The aqueous alkaline processing composition comprised:

| | |
|---|---|
| Potassium hydroxide (85%) | 4.58 g. |
| N-benzyl-α-picolinium bromide (50% solution in water) | 1.25 g. |
| N-phenethyl-α-picolinium bromide (50% solution in water) | 0.772 g. |
| Sodium carboxymethyl cellulose (Hercules Type 7H4F providing a viscosity of 3,000 cps. at 1% in water at 25° C.) 95% solids | 1.06 g. |
| Titanium dioxide | 41.8 g. |
| 6-methyl uracil | 0.29 g. |
| bis-(β-aminoethyl)-sulfide | 0.02 g. |
| Lithium nitrate | 0.22 g. |
| Benzotriazole | 0.56 g. |
| 6-methyl-5-bromo-4-azabenzimidazole | 0.03 g. |
| Colloidal silica aqueous dispersion (30% $SiO_2$) | 0.55 g. |
| N-2-hydroxyethyl-N,N',N'-tris- | 0.83 g. |

-continued carboxymethyl-ethylene diamine
Lithium hydroxide (57.2% solution in water) 0.2 g.
6-benzylamino-purine 0.39 g.
Polyethylene glycol 0.53 g. (molecular weight 6,000) 2.7 g.

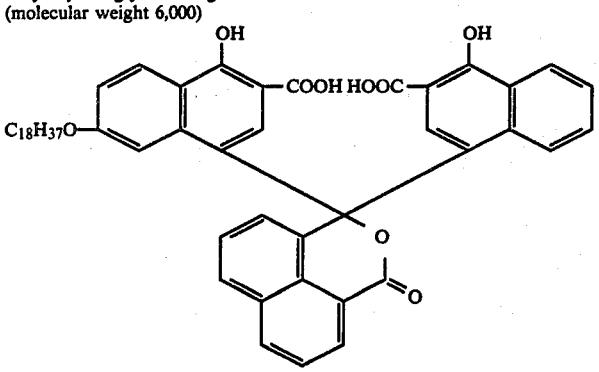

(Formula OP-1)

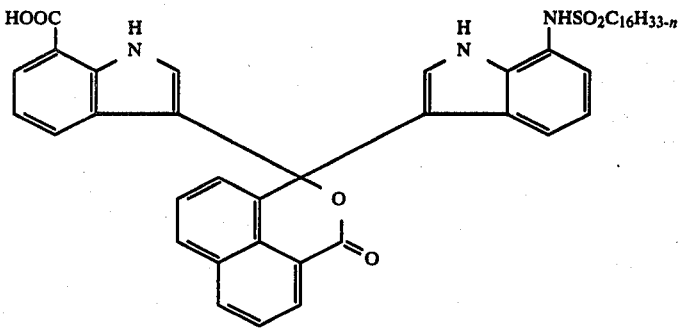

0.6 g.

water to make 100 g.

(Formula OP-2)

The photosensitive element was exposed to a 2-meter-candle-second light exposure and developed in the dark by distributing the processing composition between the image receiving component and photoexposed photosensitive component.

mgs/ft.$^2$ Measurements of the density of dye transferred from unexposed areas (neutral $D_{max}$) were made at various increments of time after application of the processing composition and the following data were obtained:

TABLE 1

| | D-MAX at 0.5 min. | | | D-MAX at 1 min. | | | D-MAX at 1.5 mins. | | | D-MAX at 2 mins. | | |
|---|---|---|---|---|---|---|---|---|---|---|---|---|
| FILM UNIT | R | G | B | R | G | B | R | G | B | R | G | B |
| CONTROL | 0.28 | 0.28 | 0.48 | 0.30 | 0.35 | 0.51 | 0.36 | 0.42 | 0.62 | 0.45 | 0.50 | 0.78 |
| N-14 | 0.34 | 0.33 | 0.44 | 0.35 | 0.36 | 0.57 | 0.37 | 0.47 | 0.74 | 0.49 | 0.61 | 0.81 |

| | D-MAX at 3 mins. | | | D-MAX at 5 mins. | | | D-MAX at 10 mins. | | |
|---|---|---|---|---|---|---|---|---|---|
| FILM UNIT | R | G | B | R | G | B | R | G | B |
| CONTROL | 0.73 | 0.68 | 1.10 | 1.32 | 1.10 | 1.30 | 1.62 | 1.69 | 1.65 |
| N-14 | 0.83 | 0.84 | 0.92 | 1.26 | 1.34 | 1.32 | 1.70 | 1.75 | 1.69 |

EXAMPLE 1

This Example involves a comparison between a film unit having a pyridine N-oxide present during development and one that does not. Both film units identified as the "Control" and "N-14" below were prepared, photoexposed and processed at 75° F. substantially as described before. However, film unit N-14 had 2-methyl pyridine N-oxide dissolved in water (Formula 3) dispersed in the gelatin layer positioned above the blue sensitive silver halide emulsion layer. This gelatin layer is identified as layer 9 in the earlier description and the amount of 2-methyl pyridine N-oxide dispersed was sufficient to provide a coverage of N-oxide of about 40

Figure 4:
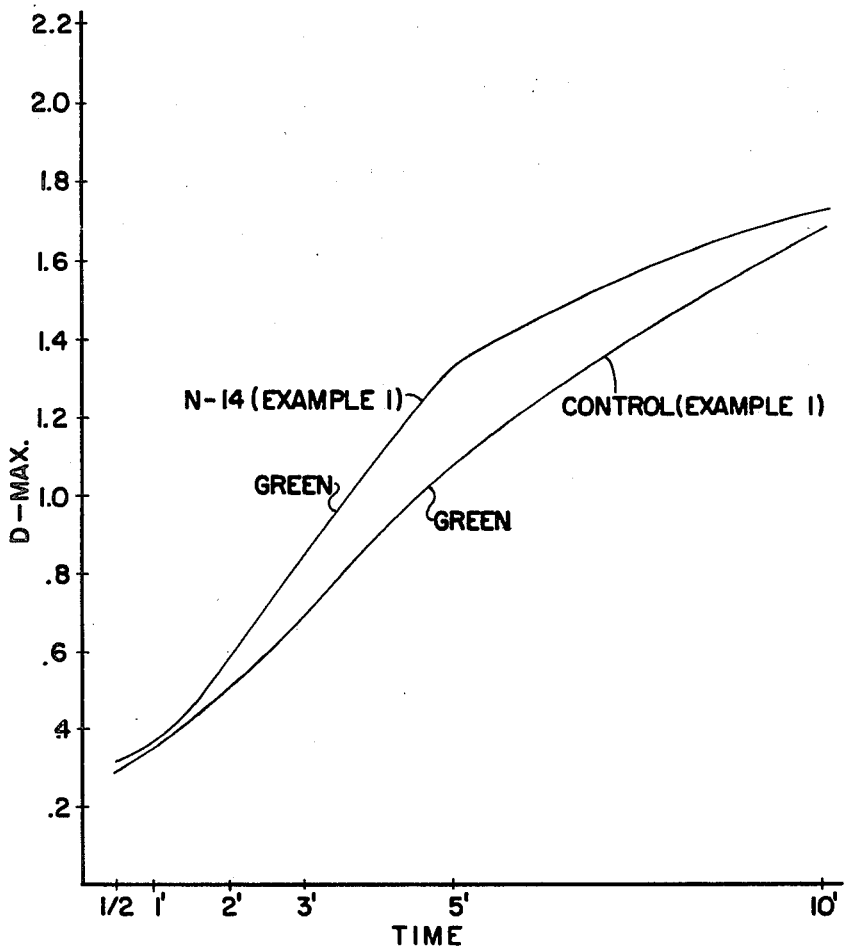
FIG. 4 presents graphical representations of dye density measurements of film units discussed in Example 1.

The green $D_{max}$ data of Table 1 are shown in graphical form in FIG. 4. A comparison of the curves of FIG. 4 reveals that slightly higher $D_{max}$ values are obtained at the various times for the film unit N-14 indicating a faster rate of transfer of dye.

EXAMPLE 2

This Example involves a comparison between film units substantially the same as the "Control" and film unit N-14 of Example 1. In this Example, the film units were prepared, exposed and processed in the manner described before. However, one set of the Control and film unit N-14 were processed at 40° F., another at 75° F. and still another at 100° F. Density measurements were made of each film unit about an hour after processing and also the magenta saturation of each film unit was measured. The magenta saturation represents the measure of magenta density when the film unit is exposed to two-meter-candle seconds of red and blue light only (no green exposure). The following data were obtained:

TABLE 2

| FILM UNIT | D-MAX 40° F. R | G | B | MAGENTA SATURATION 40° F. G | D-MAX 75° F. R | G | B | MAGENTA SATURATION 75° F. G | D-MAX 100° F. R | G | B | MAGENTA SATURATION 100° F. G |
|---|---|---|---|---|---|---|---|---|---|---|---|---|
| CONTROL | 2.0 | 1.92 | 1.71 | .58 | 1.91 | 1.66 | 1.69 | .57 | 1.27 | 1.35 | 1.34 | .60 |
| N-14 | 2.0 | 1.92 | 1.67 | .70 | 2.08 | 1.97 | 1.79 | .75 | 1.36 | 1.58 | 1.44 | .75 |

A comparison of the data of Table 2 reveals that film units having N-oxides of the present invention have increased magenta saturation in the magenta column across the temperature range and improved green densities at 75° F. and 100° F. Accordingly, the N-oxides of the present invention are particularly useful for adjusting or otherwise controlling the degree of magenta dye transfer in diffusion transfer film units.

EXAMPLE 3

Substantially the same sets of film units as in Example 2 were involved in this Example. However, the sets of film units listed as "L14" below contained pyridine N-oxide (Formula 2) dispersed in the gelatin layer (layer 9) in an amount sufficient to provide a coverage of about 50 mgms./ft.$^2$ Exposure and processing procedures were substantially the same as in Example 2 and dye density measurements were made on each set of film units after about one hour at 40° F., 75° F., and 100° F. The following data were obtained:

TABLE 3

| FILM UNIT | D-MAX 40° F. P | G | B | MAGENTA SATURATION 40° F. G | D-MAX 75° F. R | G | B | MAGENTA SATURATION 75° F. G | D-MAX 100° F. R | G | B | MAGENTA SATURATION 100° F. G |
|---|---|---|---|---|---|---|---|---|---|---|---|---|
| CONTROL | 1.90 | 1.85 | 1.86 | .63 | 1.89 | 1.94 | 2.19 | .65 | 1.27 | 1.50 | 1.60 | .51 |
| L-14 | 1.93 | 1.90 | 2.01 | .73 | 1.98 | 2.02 | 2.16 | .77 | 1.22 | 1.54 | 1.77 | .70 |

EXAMPLE 4

Film units, except for the variations set forth herein, were prepared and evaluated in the manner described in Examples 1 to 3. In the case of the film unit of this Example, the multicolor photosensitive element was prepared by coating a gelatin-subcoated, four-mil, opaque polyethylene terephthalate film base, in succession, with the following layers:

1. a layer of cyan dye developer (as described in connection with Example 1) dispersed in gelatin and coated at a coverage of about 69 mgs/ft$^2$ of dye, about 138 mgs/ft$^2$ of gelatin, about 25 mgs/ft$^2$ of 2-phenylbenzimidazole and about 6.3 mgs/ft$^2$ of 4-methylphenylhydroquinone;

2. a red-sensitive gelatino silver iodobromide emulsion coated at a coverage of about 120 mgs/ft$^2$ of silver and about 72 mgs/ft$^2$ of gelatin;

3. a layer of 60-30-4-6 copolymer of butyl acrylate, diacetone acrylamide, styrene, and methacrylic acid and polyacrylamide coated at a coverage of about 232.8 mgs/ft$^2$ of the copolymer and about 7.2 mgs/ft$^2$ of polyacrylamide;

4. a layer of magenta dye developer (as described in connection with Example 1) dispersed in gelatin and coated at a coverage of about 60 mgs/ft$^2$ of dye, about 42 mgs/ft$^2$ of gelatin, and about 21 mgs/ft$^2$ of 2-phenylbenzimidazole;

5. a green-sensitive gelatino iodobromide emulsion coated at a coverage of about 74 mgs/ft$^2$ of silver and about 36 mgs/ft$^2$ of gelatin;

6. a layer containing the copolymer referred to above in layer 3, polyacrylamide, and succinaldehyde at a coverage of about 127 mgs/ft$_2$ of the copolymer, about 8.1 mgs/ft$^2$ of polyacrylamide, and about 6.6 mgs/ft$^2$ of succinaldehyde;

7. a layer of yellow dye developer (as described in connection with Example 1) dispersed in gelatin and coated at a coverage of about 90 mgs/ft$^2$ of dye, about 42 mgs/ft$^2$ of gelatin, and about 19 mgs/ft$^2$ of 2-phenylbenzimidazole;

8. a blue-sensitive gelatino silver iodobromide emulsion layer including the auxiliary developer 4-methylphenylhydroquinone and coated at a coverage of about 119 mgs/ft$^2$ of silver, 62 mgs/ft$^2$ of gelatin, and 19 mgs/ft$^2$ of auxiliary developer;

9. a layer of gelatin coated at about 45 mgs/ft$^2$ of gelatin and containing about 4 mgs/ft$^2$ of carbon black; and 10. a layer of gelatin coated at about 30 mgs/ft$^2$ of gelatin and containing about 250 mgs/ft$^2$ of 2-picoline-1-oxide.

An image-receiving component was prepared by coating a transparent four-mil polyethylene terephthalate film base, in succession, with the following layers:

1. as a polymeric acid layer, a mixture of about 8:1 of the partial butyl ester of polyethylene/maleic anhydride copylymer and poly(vinyl butyral) at a coverage of about 2500 mgs/ft$^2$;

2. a timing layer containing about a 45:0.7 ratio of a 60-30-4-6 copolymer of butylacrylate, diacetone acrylamide, styrene and methacrylic acid and polyvinyl alcohol at a coverage of about 450 mgs/ft$^2$; and 3. a polymeric image-receiving layer containing, at a coverage of about 300 mgs/ft$^2$, a 2:1:1 mixture of polyvinyl alcohol, poly(4-vinylpyridine) and a graft copolymer, the graft copolymer being comprised of 4-vinyl pyridine (4VP) and vinylbenzyl trimethyl ammonium chloride (TMQ) grafted onto hydroxyethyl cellulose (HEC) at a ratio of HEC/4VP/TMQ of 2.2/2.2/1.

After photoexposure as described below, the two components were taped together at one end with a rupturable container (retaining an aqueous alkaline processing composition) so mounted that pressure applied to the container would rupture the marginal seal of the container and distribute the processing composition between the image-receiving layer and the N-oxide-containing gelatin layer (layer 10) of the photosensitive element. The photosensitive component was exposed to a two-meter-candle-second light exposure and was developed in the dark by passing the film unit through a pair of rollers spaced at a 0.0032 inch gap so as to uniformly distribute the processing composition between the elements as aforesaid. Development was conducted at a temperature of 75° F. The processing composition had the following composition:

Potassium hydroxide (85): 11.02 g.
N-phenethyl-α-picolinium bromide (50% solution in water): 2.66 g.
Carboxymethyl hydroxyethyl cellulose: 4.18 g.
Titanium Dioxide: 78.33 g.
6-methyl uracil: 1.5 g.
Benzotriazole: 1.12 g.
N-2-hydroxyethyl-N,N'N'-tris-carboxymethyl ethylene diamine: 1.66 g.
Colloidal silica aqueous dispersion (30% $SiO_2$): 3.86 g.
Polyethylene glycol: 0.94 g.
4-aminopyrazolo-(3,4d) pyrimidine: 0.52 g.
2-(benzimidazolyl methyl) sulfide: 0.083 g.
Opacifier dye (Formula OP-1): 2.83 g.
Opacifier dye (Formula OP-2): 0.63 g.
Water: 100 g.

For purposes of establishing a comparative reference, a control film unit (identified in Table 4 as "Control") was prepared and processed in the manner of the film unit of Example 4, except that the photosensitive element of the "Control" film unit contained a gelatin overcoat at a coverage of about 30 mgs./ft$^2$ in lieu of the N-oxide-containing layer (layer 10) of the photosensitive element of the film unit of Example 4. This Example, thus, permits comparison between a film unit having 2-picoline N-oxide present during development and a film unit ("Control") not having the 2-picoline N-oxide present during development.

In the evaluation of the "Control" and Example 4 film units, reflection density measurements were made to determine dye transferred from unexposed areas (neutral $D_{max}$) at various specified increments of time after application of the processing composition, as is set forth in the following Table 4 wherein all values of $D_{max}$ are corrected to eliminate contribution to dye density measurements of absorption by the opacification dyes of the processing composition.

2-picoline N-oxide provided, relative to the "Control" film unit, a faster rate of dye transfer. This rate is especially evident from the reported green $D_{max}$ data pertaining to transfer of magenta dye.

EXAMPLE 5

This example illustrates the performance of diffusion transfer film units having an N-oxide component included in the processing composition. Film units were prepared utilizing a multicolor photosensitive element as described in connection with the film unit of Example 4, except that layer 9 was the topmost layer, i.e., no layer 10 was present. The image-receiving element utilized was the element described in Example 4. The processing compositions utilized had the composition set forth in connection with Example 4, except that 4-picoline-1-oxide, in an amount of 3.0 g., was included as an additional ingredient.

After photoexposure as described below, the photoexposed and image-receiving components were taped together at one end with a rupturable container (retaining the aqueous alkaline processing composition) so mounted that pressure applied to the container would rupture the marginal seal of the container and distribute the processing composition between the image-receiving layer and the gelatin layer (layer 9) of the photosensitive element. The photosensitive component was exposed to a two-meter-candle-second light exposure and was developed in the dark by passing the film unit through a pair of rollers spaced at a 0.0032 inch gap so as to uniformly distribute the processing composition between the elements as aforesaid. Development was conducted at a temperature of 75° F.

For purposes of establishing a comparative reference, a control film unit (identified in Table 5 as "Control") was prepared and processed in the manner of the film unit of Example 5, except that the processing composition of the "Control" film unit contained no added 4-picoline-1-oxide, i.e., the "Control" processing composition was as described in Example 4. Example 5, thus, permits comparison between a film unit having 4-picoline N-oxide present during development, as the result of distribution of processing composition containing 4-picoline-4-oxide, and a film unit ("Control") not having the 4-picoline N-oxide present during development.

In the evaluation of the "Control" and Example 5 film units, reflective density measurements were made to determine dye transferred from unexposed areas (neutral $D_{max}$) at various specified increments of time after application of the processing composition, as is set forth in the following Table 5 wherein all values of $D_{max}$ are corrected to eliminate contribution to dye

TABLE 4

| | D-MAX at 0.5 min. | | | D-MAX at 1 min. | | | D-MAX at 1.5 mins. | | | D-MAX at 2 mins. | | | D-MAX at 2.5 mins. | | |
|---|---|---|---|---|---|---|---|---|---|---|---|---|---|---|---|
| FILM UNIT | R | G | B | R | G | B | R | G | B | R | G | B | R | G | B |
| CONTROL | 0.14 | 0.05 | 0.11 | 0.12 | 0.15 | 1.41 | 0.26 | 0.44 | 1.87 | 0.46 | 0.70 | 1.97 | 0.97 | 1.08 | 2.23 |
| Example 4 | 0.18 | 0.11 | 1.16 | 0.12 | 0.54 | 1.68 | 0.48 | 0.93 | 2.03 | 0.81 | 1.27 | 2.21 | 1.13 | 1.59 | 2.31 |

| | D-MAX at 3 mins. | | | D-MAX at 3.5 mins. | | | D-MAX at 4 mins. | | | D-MAX at 4.5 mins. | | | D-MAX at 5 mins. | | |
|---|---|---|---|---|---|---|---|---|---|---|---|---|---|---|---|
| FILM UNIT | R | G | B | R | G | B | R | G | B | R | G | B | R | G | B |
| CONTROL | 1.06 | 1.19 | 2.23 | 1.41 | 1.55 | 2.41 | 1.46 | 1.61 | 2.35 | 1.51 | 1.71 | 2.40 | 1.66 | 1.89 | 2.4 |
| Example 4 | 1.28 | 1.81 | 2.45 | 1.45 | 2.01 | 2.47 | 1.66 | 2.15 | 2.53 | 1.63 | 2.23 | 2.54 | 1.78 | 2.27 | 2.5 |

As can be seen from inspection of the data set forth in Table 4, the film unit of Example 4 having a content of density measurements of absorption by the opacification dyes present in the processing composition.

TABLE 5

| | D-MAX at 0.5 min. | | | D-MAX at 1 min. | | | D-MAX at 1.5 mins. | | | D-MAX at 2 mins. | | |
|---|---|---|---|---|---|---|---|---|---|---|---|---|
| FILM UNIT | R | G | B | R | G | B | R | G | B | R | G | B |
| CONTROL | 0.23 | 0.29 | 1.01 | 0.40 | 0.37 | 1.35 | 0.80 | 0.78 | 1.66 | 1.00 | 0.98 | 1.77 |
| Example 5 | 0.25 | 0.52 | 1.37 | 0.38 | 0.91 | 1.55 | 0.68 | 1.15 | 1.85 | 0.93 | 1.48 | 1.92 |

| | D-MAX at 2.5 mins. | | | D-MAX at 3 mins. | | | D-MAX at 5 mins. | | | D-MAX at 10 mins. | | |
|---|---|---|---|---|---|---|---|---|---|---|---|---|
| FILM UNIT | R | G | B | R | G | B | R | G | B | R | G | B |
| CONTROL | 1.37 | 1.30 | 1.91 | 1.46 | 1.46 | 1.93 | 1.64 | 1.61 | 1.98 | 1.99 | 1.81 | 1.91 |
| Example 5 | 1.24 | 1.71 | 2.02 | 1.43 | 1.89 | 2.10 | 1.82 | 2.15 | 2.19 | 2.18 | 2.19 | 2.11 |

As can be seen from inspection of the data presented in Table 5, inclusion of 4-picoline-N-oxide in the processing composition utilized for the development of the film unit of Example 5 provided, for the most part, a greater rate of dye transfer than was observed in the case of the development of the "Control" film unit.

EXAMPLE 6

This example illustrates the utilization of an N-oxide component in a layer of a photosensitive element in the production of a transparency. Film units adapted to the provision of such transparencies were prepared in the following manner. A multicolor photosensitive component was prepared by coating a gelatin-subcoated, four-mil, opaque polyethylene terephthalate film base, in succession, with the following layers:

1. a layer of cyan dye developer (as described in connection with Example 1) dispersed in gelatin and coated at a coverage of about 180 mgs/ft$^2$ of dye, about 90 mgs/ft$^2$ of gelatin and about 25 mgs/ft$^2$ of 4-methylphenyl hydroquinone;

2. a red-sensitive gelatino silver iodobromide emulsion coated at a coverage of about 209 mgs./ft$^2$ of silver and about 42 mgs/ft$^2$ of gelatin;

3. a layer of 60-30-4-6 copolymer of butyl acrylate, diacetone acrylamide, styrene, and methacrylic acid, polyacrylamide, and succinaldehyde coated at a coverage of about 252 mgs/ft$^2$ of the copolymer, about 12 mgs/ft$^2$ of polyacrylamide and about 7 mgs/ft$^2$ of succinaldehyde;

4. a layer of magenta dye developer (as described in connection with Example 1) dispersed in gelatin and coated at a coverage of about 120 mgs/ft$^2$ of dye and about 30 mgs/ft$^2$ of gelatin;

5. a green-sensitive gelatino iodobromide emulsion coated at a coverage of about 180 mgs/ft$^2$ of silver and about 36 mgs/ft$^2$ of gelatin;

6. a layer containing the copolymer referred to above in layer 3, polyacrylamide, and succinaldehyde at a coverage of about 86 mgs/ft$^2$ of the copolymer, about 10 mgs/ft$^2$ of polyacrylamide, and about 4 mgs/ft$^2$ or succinaldehyde;

7. a layer of yellow dye developer (as described in connection with Example 1) dispersed in gelatin and coated at a coverage of about 100 mgs/ft$^2$ of dye and about 25 mgs./ft$^2$ of gelatin; 8. a blue-sensitive gelatino silver iodobromoide emulsion layer including the auxiliary developer 4-methylphenyl hydroquinone and coated at a coverage of about 160 mgs/ft$^2$ of silver, about 32 mgs./ft$^2$ of gelatin, and about 40 mgs/ft$^2$ of auxiliary developer;

9. a layer of gelatin coated at a coverage of about 30 mgs/ft$^2$ of gelatin; and 10. a layer of gelatin coated at about 30 mgs/ft$^2$ of gelatin and containing about 250 mgs/ft$^2$ of a picoline N-oxide. In the case of film unit 6A, the picoline N-oxide was 2-picoline N-oxide, while in film units 6B and 6C, the picoline N-oxide was, respectively, 3-picoline N-oxide and 4-picoline N-oxide.

An image-receiving component was prepared by coating a transparent four-mil polyethylene terephthalate film base, in succession, with the following layers:

1. as a polymeric acid layer, a mixture of about 8:1 of the partial butyl ester of polyethylene/maleic anhydride copolymer and poly(vinyl butyral) at a coverage of about 2500 mgs./ft$^2$;

2. timing layer of cellulose acetate having a degree of substitution of about 2.4 and coated at a coverage of about 275 mgs./ft$^2$; and 3. a polymeric image-receiving layer containing a mixture of (a) a graft copolymer comprised of 4-vinyl pyridine (4VP) and vinylbenzyl trimethyl ammonium chloride (TMQ) grafted onto hydroxyethyl cellulose (HEC) at a ratio of HEC/4VP/TMQ of 2.2/2.2/1, (b) poly(vinylbenzyl trimethyl ammonium chloride). (c) Pluronic F-127 polyoxyethylene polyoxypropylene block copolymer wetting agent, avg. mol. wt. about 12,500, from BASF Wyandotte Corp., (d) a mixture of cis- and trans-4,5-cyclopentatetrahydropyrimidine-2-thiol, component (a) being coated at a coverage of about 300 mgs./ft$^2$, component (b) at about 50 mgs./ft$^2$, component (c) at about 10 mgs./ft$^2$, and component (d) at about 15 mgs./ft$^2$; and 4. a strip-coat of gum arabic containing ammonium hydroxide and wetting agent coated at a coverage of about 43 mgs./ft$^2$.

After photoexposure as described below, the photoexposed component and image-receiving component were superposed and taped together at one end with a rupturable container (retaining an aqueous alkaline processing composition) mounted therebetween such that pressure applied to the container would rupture the marginal seal of the container and distribute the processing composition between the image-receiving layer and the N-oxide-containing gelatin layer (layer 10) of the photosensitive component. The photosensitive component was exposed to a two-meter-candle-second light exposure and was developed in the dark by passing the film unit through a pair of rollers spaced at a 0.0030 inch gap so as to uniformly distribute the processing composition between the components as aforesaid. Development was conducted at a temperature of 75° F. The image-receiving component was, after a period of imbibition specified in Table 6, peeled apart from the developed photosensitive component. The processing composition utilized in the film units had the following composition:

Sodium hydroxide: 7.0 g.
Zinc nitrate: 0.6 g.
6-benzylamino purine: 1.0 g.
N-benzyl-α-picolinium bromide: 2.0 g.
N-phenethyl-α-picolinium bromide: 1.5 g.
4-aminopyrazolo-(3,4d) pyrimidine: 1.0 g.
Hydroxyethyl cellulose: 2.0 g.
Benzotriazole: 3.0 g.
Water: 100 g.

For purposes of establishing a comparative reference, a control film unit (identified in Table 6 as "Control") was prepared and processed in the manner of the film units of Example 6, except that the photosensitive element of the "Control" film unit contained a layer of gelatin coated at a coverage of about 30 mgs/ft$^2$ in lieu of the N-oxide-containing layer (layer 10) of the photosensitive elements of the film units of Example 6. This Example, thus, permits comparison between film units having a picoline N-oxide present during development and a film unit ("Control") not having the picoline N-oxide present during development.

In the evaluation of the "Control" and Example 6 film units, transmission density measurements were made to determine dye transferred from unexposed areas (neutral $P_{max}$) at various specified increments of time after application of the processing composition, as is set forth in the following Table 6.

TABLE 6

| FILM UNIT | D-MAX at 0.5 min. | | | D-MAX at 1 min. | | | D-MAX at 1.5 mins. | | |
|---|---|---|---|---|---|---|---|---|---|
| | R | G | B | R | G | B | R | G | B |
| CONTROL | 0.28 | 0.46 | 1.13 | 0.85 | 1.09 | 1.78 | 1.49 | 1.55 | 2.02 |
| Example 6A (2-Picoline-N-Oxide) | 0.35 | 0.57 | 1.01 | 1.13 | 1.14 | 1.44 | 1.72 | 1.39 | 1.55 |
| Example 6B (3-Picoline-N-Oxide) | 0.36 | 0.78 | 1.35 | 1.06 | 1.46 | 1.96 | 1.68 | 1.88 | 2.12 |
| Example 6C (4-Picoline-N-Oxide) | 0.37 | 0.71 | 1.26 | 1.03 | 1.40 | 1.82 | 1.70 | 1.80 | 2.08 |

| FILM UNIT | D-MAX at 2 mins. | | | D-MAX at 2.5 mins. | | | D-MAX at 3 mins. | | |
|---|---|---|---|---|---|---|---|---|---|
| | R | G | B | R | G | B | R | G | B |
| CONTROL | 1.95 | 1.70 | 1.83 | 2.12 | 1.72 | 1.90 | 2.42 | 1.89 | 1.98 |
| Example 6A (2-Picoline-N-Oxide) | 2.04 | 1.81 | 1.79 | 2.32 | 1.86 | 1.83 | 2.72 | 2.06 | 1.96 |
| Example 6B (3-Picoline-N-Oxide) | 2.21 | 2.07 | 2.20 | 2.44 | 1.96 | 2.04 | 2.66 | 2.20 | 2.11 |
| Example 6C (4-Picoline-N-Oxide) | 2.18 | 2.03 | 2.17 | 2.58 | 2.25 | 2.26 | 2.78 | 2.34 | 2.24 |

As can be seen from inspection of the results reported in Table 6, incorporation of an N-oxide component in the photosensitive components of film units 6A through 6C provided, relative to the "Control" film unit, a greater rate of dye transfer.

EXAMPLE 7

This Example illustrates the utilization of an N-oxide component in a processing composition employed for the processing of a diffusion transfer film unit adapted to the provision of a transparency image. Film units were prepared from photosensitive and image-receiving elements and processing compositions as described herein and were processed and evaluated in the manner described in Example 6.

The multicolor photosensitive component utilized in the film units of this Example, identified in Table 7 as film units 7A through 7C, was the photosensitive component described in Example 6, except that the #10 layer was not employed, i.e., the outermost layer was the gelatin layer (layer #9) at a coverage of about 30 mgs./ft$^2$. Film units 7A through 7C included as an image-receiving component, the image-receiving component described in detail in Example 6.

The processing compositions of film units 7A through 7C had the following composition:

Sodium hydroxide: 7.0 g.
Zinc nitrate: 0.6 g.
6-benzylamino-purine: 1.0 g.
N-benzyl-α-picolinium bromide: 2.0 g.
N-phenethyl-α-picolinium bromide: 1.5 g.
4-amino-pyrazolo (3,4d) pyrimidine: 1.0 g.
Hydroxethyl cellulose: 2.0 g.
Picoline-N-oxide*: 3.0 g.
Water: 100 g.

*2-Picoline-N-oxide in film unit 7A, 3-Picoline-N-oxide in film unit 7B, 4-Picoline-N-oxide in film unit 7C.

The film units of this Example were photoexposed and processed in the manner described in Example 6. As a "Control" film unit, a film unit utilizing the same photosensitive and image-receiving components as film units 7A through 7C were prepared. The processing composition utilized in the "Control" film unit included no N-oxide component and had the following composition:

Sodium hydroxide: 7.0 g.
Zinc nitrate: 0.6 g.
6-benzylamino-purine: 1.0 g.
N-benzyl-α-picolinium bromide: 2.0 g.
N-phenethyl-α-picolinium bromide: 1.5 g.
4-amino-pyrazolo (3,4d) pyrimidine: 1.0 g.
Hydroxyethyl cellulose: 2.0 g.
Water: 100 g.

The "Control" and film units 7A through 7C were evaluated in the manner described in Example 6 and dye density measurements were made at specified increments of time after application of the process composition and the following results were obtained and are set forth in Table 7.

TABLE 7

| FILM UNIT | D-MAX at 0.5 min. | | | D-MAX at 1 min. | | | D-MAX 1.5 mins. | | |
|---|---|---|---|---|---|---|---|---|---|
| | R | G | B | R | G | B | R | G | B |
| CONTROL | 0.26 | 0.35 | 1.02 | 0.74 | 0.81 | 1.47 | 1.29 | 1.13 | 1.60 |
| Example 7A (2-Picoline-N-Oxide) | 0.31 | 0.82 | 1.60 | 0.95 | 1.52 | 2.03 | 1.67 | 1.97 | 2.31 |
| Example 7B (3-Picoline-N-Oxide) | 0.33 | 0.84 | 1.57 | 1.14 | 1.62 | 1.96 | 1.55 | 1.81 | 2.11 |

TABLE 7-continued

| | | | | | | | | | |
|---|---|---|---|---|---|---|---|---|---|
| Example 7C (4-Picoline-N-Oxide) | 0.37 | 0.90 | 1.63 | 1.07 | 1.60 | 2.17 | 1.75 | 1.94 | 2.31 |

| | D-MAX 2 mins. | | | D-MAX 2.5 mins. | | | D-MAX at 3 mins. | | |
|---|---|---|---|---|---|---|---|---|---|
| FILM UNIT | R | G | B | R | G | B | R | G | B |
| CONTROL | 1.68 | 1.37 | 1.82 | 2.05 | 1.52 | 1.82 | 2.28 | 1.66 | 1.89 |
| Example 7A (2-Picoline-N-Oxide) | 2.11 | 2.15 | 2.37 | 2.52 | 2.30 | 2.42 | 2.60 | 2.31 | 2.40 |
| Example 7B (3-Picoline-N-Oxide) | 2.07 | 2.17 | 2.18 | 2.46 | 2.23 | 2.24 | 2.56 | 2.22 | 2.22 |
| Example 7C (4-Picoline-N-Oxide) | 2.20 | 2.09 | 2.28 | 2.59 | 2.28 | 2.30 | 2.72 | 2.35 | 2.32 |

From inspection of the results set forth in Table 7, it can be seen that the incorporation of an N-oxide component in a processing composition utilized for the processing of a diffusion transfer image provides an increased rate of dye transfer relative to the rate of dye transfer obtained in the case of the processing of a corresponding film unit with a processing composition not including such an N-oxide component.

What is claimed is:

1. A diffusion transfer film unit comprising: a photosensitive element comprising at least a photosensitive silver halide emulsion layer having associated therewith a dye developer; a dyeable receiving layer adapted to receive an imagewise distribution of diffusible dye developer image-providing material; means for retaining a diffusion transfer processing composition integrated with the film unit; and within said film unit an N-oxide having a polarographic reduction potential less positive than the polarographic oxidation potential of said dye developer and conforming to the formula

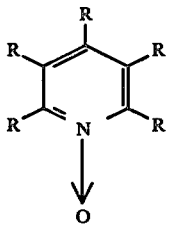

where each R can be hydrogen or methyl or one of said R groups can be:

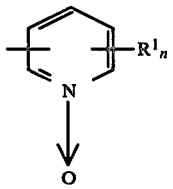

wherein $R^1$ is methyl and n is zero or an integer of from 1 to 4.

2. A diffusion transfer film unit of claim 1 wherein each of said R groups of said N-oxide is hydrogen.

3. A diffusion transfer film unit of claim 1 wherein one of said R groups of said N-oxide is methyl and each of the remaining said R groups is hydrogen.

4. A diffusion transfer film unit of claim 1 wherein said N-oxide conforms to the formula

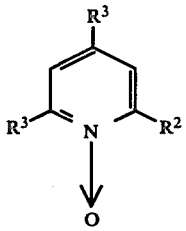

where $R^2$ or $R^3$ can be hydrogen or methyl or $R^2$ can be:

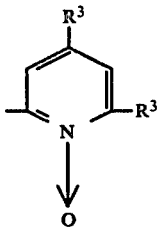

5. A diffusion transfer film unit of claim 1 wherein the N-oxide is chosen from the group consisting of:

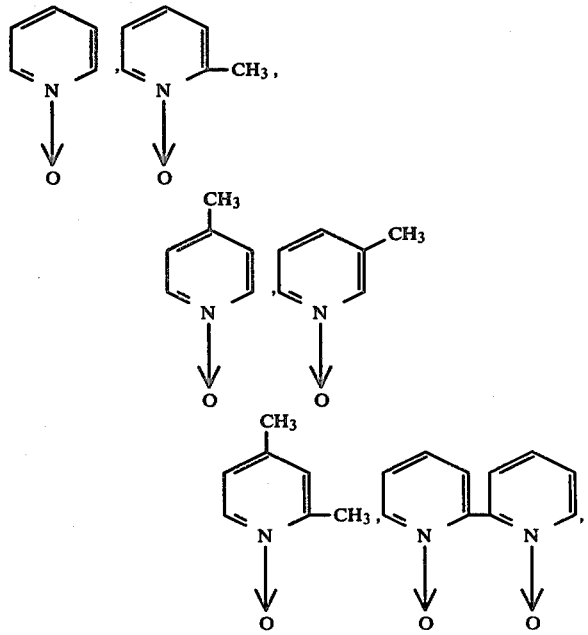

or mixtures of these

6. A diffusion transfer film unit of claim 1 wherein said N-oxide is present in said diffusion transfer film unit in a layer permeable to said processing composition.

7. A diffusion transfer film unit of claim 6 wherein the layer containing said N-oxide comprises gelatin.

8. A diffusion transfer film unit of claim 6 wherein the amount of N-oxide contained in said layer is sufficient to provide a coverage of N-oxide between about 20 to about 150 mgs./ft$^2$.

9. A diffusion transfer film unit of claim 1 wherein said dyeable receiving layer is adapted to be superposed over said photosensitive element after photoexposure and is adapted to separation from the photoexposed photosensitive element after processing.

10. A diffusion transfer film unit of claim 9 wherein said dyeable receiving layer is supported by an opaque support and said dye developer image-providing material can be viewed in the dyeable layer by reflected light after separation.

11. A diffusion transfer film unit of claim 9 wherein said dyeable receiving layer is supported by a transparent support and said dye developer image-providing material can be viewed as a transparency after separation.

12. A diffusion transfer film unit of claim 1 wherein said N-oxide is present in said processing composition.

13. A diffusion transfer film unit of claim 12 wherein each of said R groups of said N-oxide present in said processing composition is hydrogen.

14. A diffusion transfer film unit of claim 12 wherein one of said R groups of said N-oxide present in said processing composition is methyl and each of the remaining said R groups is hydrogen.

15. A diffusion transfer film unit comprising as essential elements, a support, a photosensitive system which comprises a silver halide emulsion layer associated with a dye developer, a diffusion transfer processing composition permeable layer containing an N-oxide having a polarographic reduction potential less positive than the polarographic oxidation potential of said dye developer and conforming to the formula:

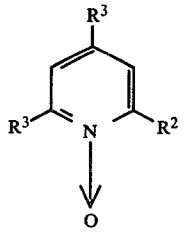

where $R^2$ or $R^3$ can be hydrogen or methyl or $R^2$ can be:

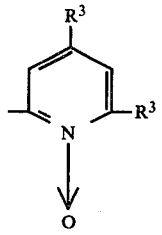

and, a dyeable receiving layer adapted to receive diffusible dye developer after photoexposure and processing of the photosensitive system.

16. A film unit of claim 15 where the layer containing the N-oxide comprises gelatin.

17. A film unit of claim 15 where the amount of N-oxide contained in the layer is sufficient to provide a coverage of N-oxide between about 20 to about 150 mgms. of N-oxide/ft$^2$.

18. A film unit of claim 15 where the N-oxide is chosen from the group consisting of:

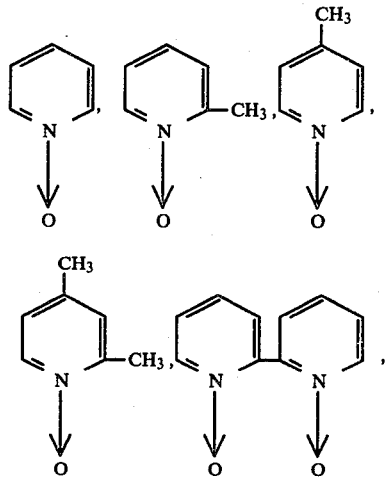

or mixtures of these.

19. A diffusion transfer film unit comprising a support; a photosensitive system comprising a silver halide emulsion layer associated with a dye developer; a diffusion transfer processing composition permeable layer containing an N-oxide having a polarographic reduction potential less positive than the polarographic oxidation potential of said dye developer and conforming to the formula:

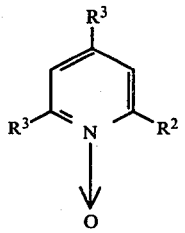

where $R^2$ or $R^3$ can be hydrogen or methyl or $R^2$ can be:

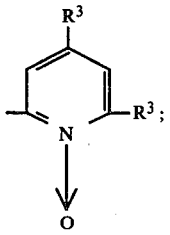

a dyeable receiving layer adapted to receive diffusible dye developer after photoexposure of the photosensitive system and the application of a diffusion transfer processing composition to the photoexposed photosensitive system and, means for retaining a diffusion transfer processing composition and integrated with the film unit for discharge of its contents within the film unit for processing the photoexposed system.

20. A film unit of claim 19 where the dyeable receiving layer is adapted to be superposed over the photosensitive system after photoexposure and adapted for separation from the photoexposed photosensitive system after processing so that the dye developer transfer image can be viewed in the dyeable layer after separation.

21. A film unit of claim 19 where the dyeable receiving layer is adapted for viewing the dye developer transfer image in the dyeable layer without separation of the dyeable layer from the developed photosensitive system.

22. A film unit of claim 19 where the layer containing the N-oxide comprises gelatin.

23. A film unit of claim 19 where the layer containing the N-oxide contains an amount of N-oxide sufficient to provide a coverage between about 20 to about 150 mgms. of N-oxide/ft$^2$.

24. A film unit of claim 19 where the N-oxide is chosen from the group consisting of:

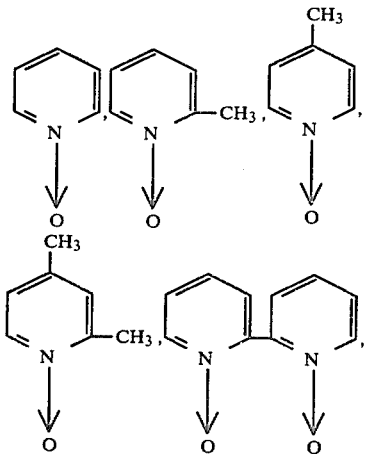

or mixtures of these

25. A film unit which comprises a photosensitive element which includes the following in order: an opaque support; at least one silver halide emulsion layer associated with a dye developer and a diffusion transfer processing composition permeable layer containing an N-oxide having a polarographic reduction potential less positive than the polarographic oxidation potential of said dye developer and conforming to the following formula:

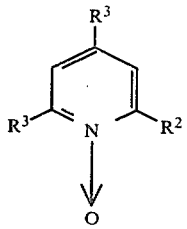

where $R^2$ or $R^3$ can be hydrogen or methyl or $R^2$ can be:

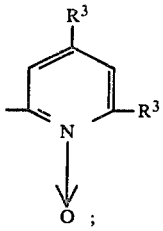

an image-receiving element adapted to be superposed on the photosensitive element after photoexposure and which includes the following in order: a dyeable layer and an opaque support and means for retaining a diffusion transfer processing composition adapted for discharge of its contents between the dyeable layer and the layer containing the N-oxide.

26. A film unit which comprises the following, in order: a transparent support, a layer containing an N-oxide, at least one silver halide emulsion layer associated with a dye developer, an opaque layer, a light reflective layer, a dyeable layer and means for retaining an opaque processing composition adapted for discharge of its contents between the transparent support and the N-oxide containing layer and wherein said N-oxide has a polarographic reduction potential less positive than the polarographic oxidation potential of said dye developer and conforms to the following formula:

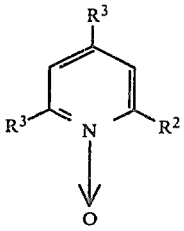

where each $R^2$ and $R^3$ can be hydrogen, or methyl or $R^2$ can be:

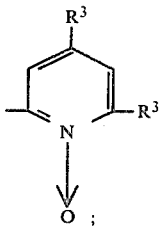

27. A film unit which comprises a photosensitive element which includes the following, in order: an opaque support, at least one silver halide layer associated with a dye developer, a layer containing an N-oxide having a polarographic reduction potential less positive than the polarograph oxidation potential of said dye developer and conforming to the following formula:

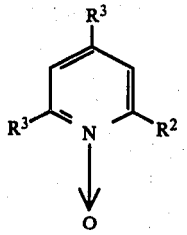

where each $R^2$ and $R^3$ can be hydrogen or methyl or $R^2$ can be:

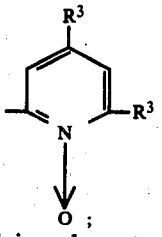

and an image-receiving element which includes the following in order: a dyeable layer and a transparent support and, means for retaining an opaque processing composition which includes a reflective pigment and which is adapted for discharge of its contents between the dyeable layer and the N-oxide containing layer.

28. A photosensitive element which comprises a support layer, at least one silver halide emulsion layer associated with a dye developer and an N-oxide which is substantially soluble in aqueous alkaline processing compositions integrated with a processing composition permeable layer of the element, said N-oxide having a polarographic reduction potential less positive than the polarographic oxidation potential of said dye developer and conforming to the following formula:

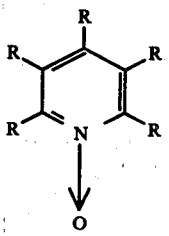

where each R can be hydrogen or methyl or one of said R groups can be:

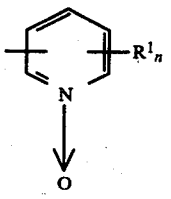

where $R^1$ is methyl and n is zero or an integer of from 1 to 4.

29. A diffusion transfer film unit of claim 28 wherein each of said R groups of said N-oxide is hydrogen.

30. A diffusion transfer film unit of claim 28 wherein one of said R groups of said N-oxide is methyl and each of the remaining of said R groups is hydrogen.

31. A photosensitive element for a diffusion transfer film unit which comprises a support layer, at least one silver halide emulsion layer associated with a dye developer and an N-oxide which is substantially soluble in aqueous alkaline processing compositions integrated with a processing composition permeable layer of the element, said N-oxide having a polarographic reduction potential less positive than the polarographic oxidation potential of said dye developer and conforming to the following formula:

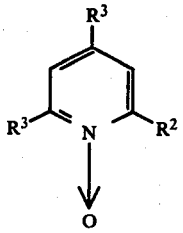

where eacn $R^2$ and $R^3$ can be hydrogen or methyl or $R^2$ can be:

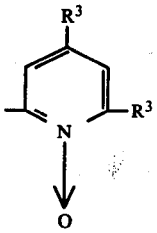

32. An element of claim 31 where the N-oxide is dispersed in a layer comprising gelatin.

33. An element of claim 31 where the N-oxide is dispersed in the layer in an amount sufficient to provide a coverage between about 20 to about 200 mgms. of N-oxide/$ft^2$.

34. An element of claim 31 where the n-oxide is chosen from the group consisting of:

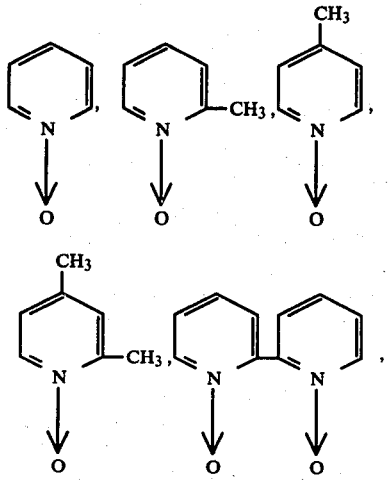

or mixtures of these.

35. A diffusion transfer process which comprises the steps of:

(a) photoexposing a photosensitive element which includes at least one silver halide emulsion layer associated with a dye developer;

(b) contacting the photoexposed element with a processing composition so that said photoexposed silver halide emulsion layer and associated dye developer can be processed in the presence of an N-oxide substantially soluble in said processing composition, said N-oxide having a polarographic reduction potential less positive than the polarographic oxidation potential of said dye developer(s) and conforming to the following formula:

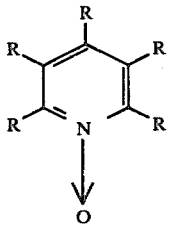

where each R can be hydrogen or methyl or one of said R groups can be:

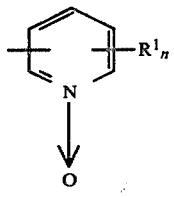

wherein $R^1$ is methyl and n is zero or an integer of from 1 to 4; and (c) developing said photoexposed silver halide layer to provide, as a function of said development, an imagewise distribution of dye image providing material which is transferred by diffusion to an image receiving layer.

36. A diffusion transfer process of claim 35 wherein each of said R groups of said N-oxide is hydrogen.

37. A diffusion transfer process of claim 35 wherein one of said R groups of said N-oxide is methyl and each of the remaining of said R groups is hydrogen.

38. A diffusion transfer process of claim 35 wherein said N-oxide is present in said diffusion transfer film unit in a layer permeable to said processing composition.

39. A diffusion transfer process of claim 35 wherein said N-oxide is present in said processing composition.

40. A diffusion transfer process of claim 39 wherein each of said R groups of said N-oxide present in said processing composition is hydrogen.

41. A diffusion transfer process of claim 39 wherein one of said R groups of said N-oxide present in said processing composition is methyl and each of the remaining said R groups is hydrogen.

42. A diffusion transfer process which comprises the steps of:

(a) photoexposing a photosensitive element which includes at least one silver halide emulsion layer associated with a dye developer and having an N-oxide which is substantially soluble in an aqueous alkaline processing composition integrated with a processing composition permeable layer of the element and where said N-oxide has a polarographic reduction potential less positive than the polarographic oxidation potential of said dye developer(s) and said N-oxide conforms to the following formula:

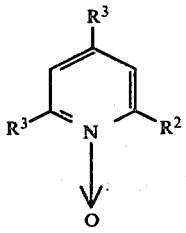

where each $R^2$ and $R^3$ can be hydrogen or methyl or $R^2$ can be:

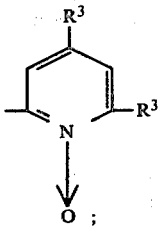

(b) contacting the photoexposed element with an aqueous alkaline processing composition so that said photoexposed silver halide emulsion layer and associated dye developer can be processed in the presence of the N-oxide; and (c) developing said photoexposed silver halide layer to provide, as a function of said development, an imagewise distribution of dye image providing material which is transferred by diffusion to an image receiving layer.

43. A process of claim 42 where the N-oxide is dispersed in a layer comprising gelatin.

44. A process of claim 42 where the N-oxide is dispersed in said layer in an amount sufficient to provide a coverage between about 20 to about 150 mgms. of N-oxide/ft.$^2$

45. A process of claim 42 where the N-oxide is chosen from the group consisting of:

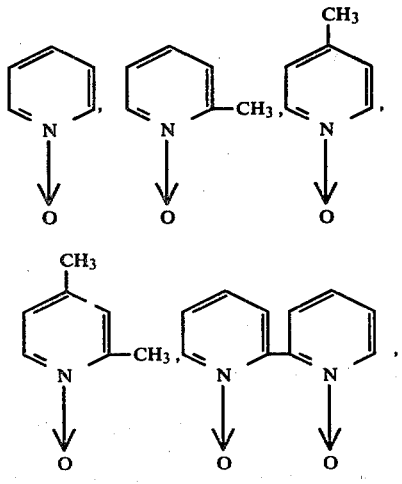

or mixtures of these.

* * * * *

UNITED STATES PATENT AND TRADEMARK OFFICE

CERTIFICATE OF CORRECTION

PATENT NO. : 4,203,766

DATED : May 20, 1980

INVENTOR(S) : Gerard J. Bourgeois et al

It is certified that error appears in the above-identified patent and that said Letters Patent are hereby corrected as shown below:

Col. 2, line 67, delete "4,4-axopyridine " and insert --4,4-azopyridine -- therefor.

Col. 4, line 17, delete "are" (first occurrence) and insert --and-- therefor.

Col. 5, line 44, delete "due" and insert --dye-- therefor.

Col. 5, line 50, after "image", insert --layer--.

Col. 5, line 53, after "10b", insert --by--.

Col. 6, line 14, delete "one" and insert --some-- therefor.

Col. 6, line 68, after "another", insert --along--.

Col. 9, line 10, delete "formula" and insert --formulae-- therefor.

Col. 15, TABLE 3, delete "P" and insert --R-- therefor.

Col. 16, line 22, delete "$ft_2$" and insert --$ft^2$-- therefor.

Col. 16, line 56, delete "copylymer" and insert --copolymer-- therefor.

Col. 18, line 44, delete "4-picoline-4-oxide" and insert --4-picoline-N-oxide-- therefor.

UNITED STATES PATENT AND TRADEMARK OFFICE

CERTIFICATE OF CORRECTION

PATENT NO. : 4,203,766

DATED : May 20, 1980

INVENTOR(S) : Gerard J. Bourgeois et al

It is certified that error appears in the above-identified patent and that said Letters Patent are hereby corrected as shown below:

Col. 18, TABLE 4, under heading "B" (last occurrence), delete "2.4" and insert --2.45-- therefor; and delete "2.5" and insert --2.50-- therefor.

Col. 19, line 58, delete "or" and insert --of-- therefor.

Col. 21, line 27, delete "$P_{max}$" and insert --$D_{max}$-- therefor.

Col. 22, line 58, delete "process" and insert --processing-- therefor.

Claim 34, line 1, delete "n-oxide" and insert --N-oxide-- therefor.

Signed and Sealed this

*Twelfth* Day of *August 1980*

[SEAL]

*Attest:*

SIDNEY A. DIAMOND

*Attesting Officer*

*Commissioner of Patents and Trademarks*